US009320974B1

(12) United States Patent
Keyes

(10) Patent No.: US 9,320,974 B1
(45) Date of Patent: Apr. 26, 2016

(54) RECREATIONAL SWING SET

(71) Applicant: Brian Keyes, Columbus, NE (US)

(72) Inventor: Brian Keyes, Columbus, NE (US)

( * ) Notice: Subject to any disclaimer, the term of this patent is extended or adjusted under 35 U.S.C. 154(b) by 0 days.

(21) Appl. No.: 14/852,529

(22) Filed: Sep. 12, 2015

(51) Int. Cl.
*A63G 9/02* (2006.01)
*F16M 11/32* (2006.01)

(52) U.S. Cl.
CPC ..... *A63G 9/02* (2013.01)

(58) Field of Classification Search
CPC ..... A63G 1/00; A63G 1/12; A63G 9/00; A63G 9/02; A63G 9/08; A63B 2009/006; F16M 11/00; F16M 11/32
USPC ..... 472/118–125; 482/33–36; 248/156, 248/163.2, 188
See application file for complete search history.

(56) References Cited

U.S. PATENT DOCUMENTS 5,529,539 A * 6/1996 Hoffman ..... A63G 9/08 472/118
5,865,680 A * 2/1999 Briggs ..... A63B 9/00 472/128
8,033,922 B1 * 10/2011 Marquez ..... A63G 1/12 472/118

* cited by examiner

*Primary Examiner* — Kien Nguyen
(74) *Attorney, Agent, or Firm* — Gulf Coast Intellectual Property Group

(57) ABSTRACT

A swing set designed to have improved structural integrity wherein the swing set includes components manufactured from either 3500 psi concrete or 5000 psi concrete. The swing set includes a first vertical column and a second vertical column that are in axial alignment and further include a portion thereof inserted into the ground. The first vertical column and second vertical column are superposed concrete mounting pads. A horizontal crossbeam is coupled to the upper ends of the first vertical column and second vertical column and functions to have a plurality of swings suspendedly mounted thereto. The first vertical column and second vertical column further include a mounting structure operable to mateably couple with a portion of the horizontal crossbeam. The aforementioned swing set elements additionally include metal support bars of varying sizes and additionally have stirrups coupled thereto wherein the stirrups vary in distance between centers.

14 Claims, 2 Drawing Sheets

RECREATIONAL SWING SET

PRIORITY UNDER 35 U.S.C SECTION 119(E) & 37 C.F.R. SECTION 1.78

This nonprovisional application claims priority based upon the following prior U.S. Provisional Patent Application entitled: Swing Set, Application No.: 62/051,815 filed Sep. 17, 2014, in the name of Brian Keyes, which is hereby incorporated by reference for all purposes.

FIELD OF THE INVENTION

The present invention relates generally to a recreational swing set, more specifically but not by way of limitation, a swing set that utilizes two support columns and a cross beam to create a secure platform for at least six swings.

BACKGROUND

Millions of recreational swing sets are installed in backyards in the United States. Swing sets are known in the art and will typically include at least one swing and a another item such as but not limited to a slide. As is known in the art, most conventional swing sets are manufactured from either wood or tubular steel. Many of the former are provided in kits that are ready to assemble and can include a variety of items such as but not limited to swings, rope ladders and slides. The latter type, tubular steel, are also very popular due to their price point. A typical tubular steel swing set can be purchased for a couple of hundred of dollars and is provided as a self-assembly kit. The tubular steel swing sets are also inclusive of swings and other paraphernalia such as but not limited to slides.

One problem the aforementioned swing set is their structural integrity and stability. A conventional tubular steel swing set typically will only weigh a couple of hundred pounds. Their have been numerous accidents involving these conventional tubular steel swing sets wherein the entire swing set was toppled due to the centrifugal force from a child swinging on the swing set. Despite these types of swing sets being provided with anchors, the aforementioned scenario is a regular occurrence. Additionally, the materials of tubular steel and or wood have proven to lack durability and detiorate as a result of exposure to the elements. Continuous exposure to the elements further erodes the structural integrity of these conventional swing sets.

Accordingly, there is a need for a swing set with improved structural integrity that utilizes a pair of vertical columns configured to support a cross beam wherein the structural integrity of the swing set facilitates the support of at least six swings.

SUMMARY OF THE INVENTION

It is the object of the present invention to provide a swing set that is operable to support and have operably coupled thereto at least six swings wherein the swing set includes two vertical support columns.

Another object of the present invention is to provide a swing set that is operable to have improved structural integrity that further includes a horizontal cross beam that is operably coupled with the two vertical support columns.

A further object of the present invention is to provide a swing set that is operable to provide improved structural integrity wherein the vertical columns and horizontal are manufactured from either 3500 psi concrete or 5000 psi concrete.

Still another object of the present invention is to provide a swing set having enhanced structural integrity that further includes concrete pads wherein the vertical columns are operably coupled to the concrete pads and wherein the concrete pads extend below the frost line of the ground.

An additional object of the present invention is to provide a swing set operable to provide support for at least six swings wherein the swing set provides improved structural integrity wherein the vertical support columns include a plurality of #5 metal bars disposed therein.

Yet a further object of the present invention is to provide a swing set having improved structural integrity and is further substantially resistant to weather elements wherein the horizontal cross beam includes a plurality of #5 bars and #6 bars disposed therein.

Another object of the present invention is to provide a swing set operable to provide a stable platform for at least six swings wherein the horizontal cross beam is further secured to the vertical support columns with a mechanical fastener.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figures 1, 2:
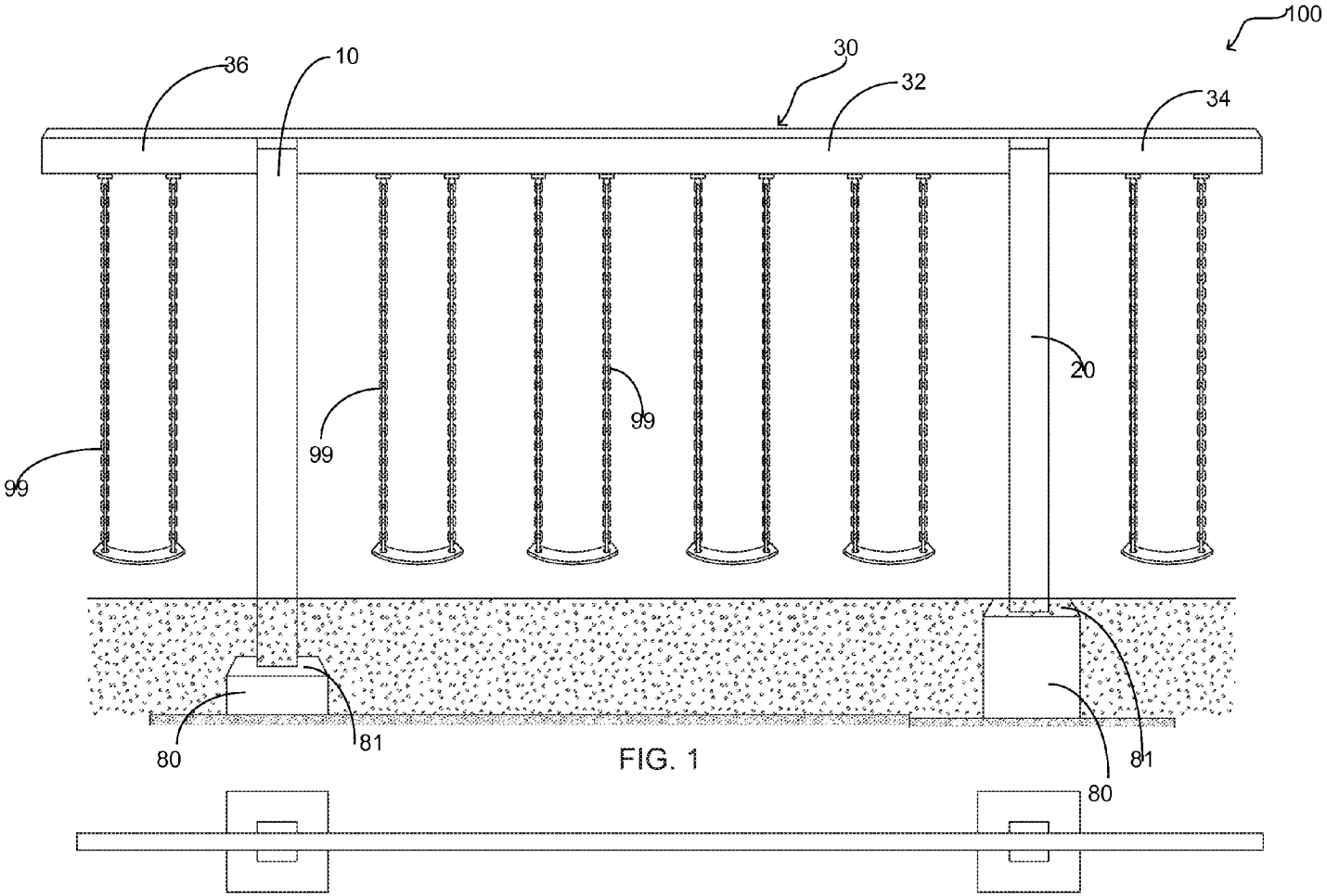
FIG. 1 is a top view of the present invention.
FIG. 2 is a perspective view of the present invention.

Referring now to the drawings submitted herewith, wherein various elements depicted therein are not necessarily drawn to scale and wherein through the views and figures like elements are referenced with identical reference numerals, there is illustrated a swing set 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the swing set 100 includes a first vertical column 10 and a second vertical column 20. The first vertical column 10 and second vertical column 20 are superposed mounting pad 80. The first vertical column 10 is manufactured from concrete and is spaced approximately twenty to twenty one feet from the second vertical column 20. The second vertical column 20 is in axial alignment with the first vertical column 10 and is also manufactured from concrete. It is preferred within the scope of the present invention that the concrete comprising the first vertical column 10 and second vertical column 20 be selected from either 3500 psi concrete or 5000 psi concrete. Additionally, while no particular height is required for the first vertical column 10 and second vertical column 20 it contemplated within the preferred embodiment that the height of the first vertical column 10 and second vertical column 20 is approximately fifteen feet. The mounting pads 80 provide the required structural support for the first vertical column 10 and second vertical column 20. FIG. 1 shows herein a first contemplated embodiment and a second contemplated embodiment of the mounting pad 80 wherein the depth into the ground is greater. It is required in the preferred embodiment of the present invention that the minimum thickness of the mounting pad 80 is sixteen inches thick. Alternatively, it is further contemplated within the scope of the present invention that the mounting pad 80 could be manufactured to a thickness of three feet. The mounting pad 80 is manufactured from the aforementioned 3500 psi concrete or 5000 psi concrete. Additionally, in the scope of the preferred embodiment of the present invention the mounting pad 80 is constructed to a size being three feet by three feet to comprise a nine square foot upper surface 81.

Figure 3:
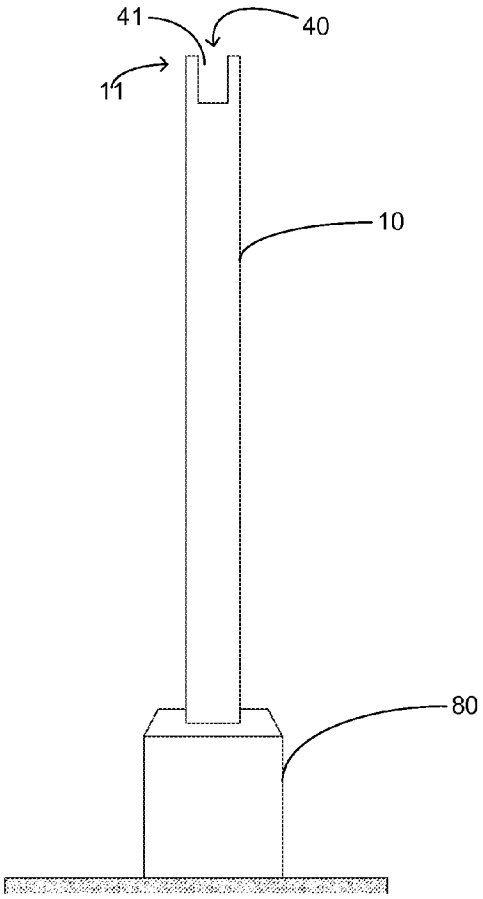
FIG. 3 is a side view of a vertical support column.

In the preferred embodiment of the present invention, the first vertical support column 10 and the second vertical support column 20 are manufactured to be sixteen inches by sixteen inches. Furthermore, in the preferred embodiment of the present invention the first vertical column 10 and second vertical column 20 include four reinforcement bars (not illustrated herein) that extend the length of the first vertical column 10 and second vertical column 20. The first vertical column 10 and the second vertical column 20 include #4 stirrups at forty-eight inches on center. Referring in particular to FIG. 3, the first vertical column 10 includes mounting structure 40 proximate the top 11. The mounting structure 40 includes void 41 that is square u-shaped and is sized so as to accommodate a portion of the horizontal crossbeam 30 therein. While not particularly illustrated herein, the second vertical column 20 also includes a mounting structure identical to that of the first vertical column 10.

Figure 4:
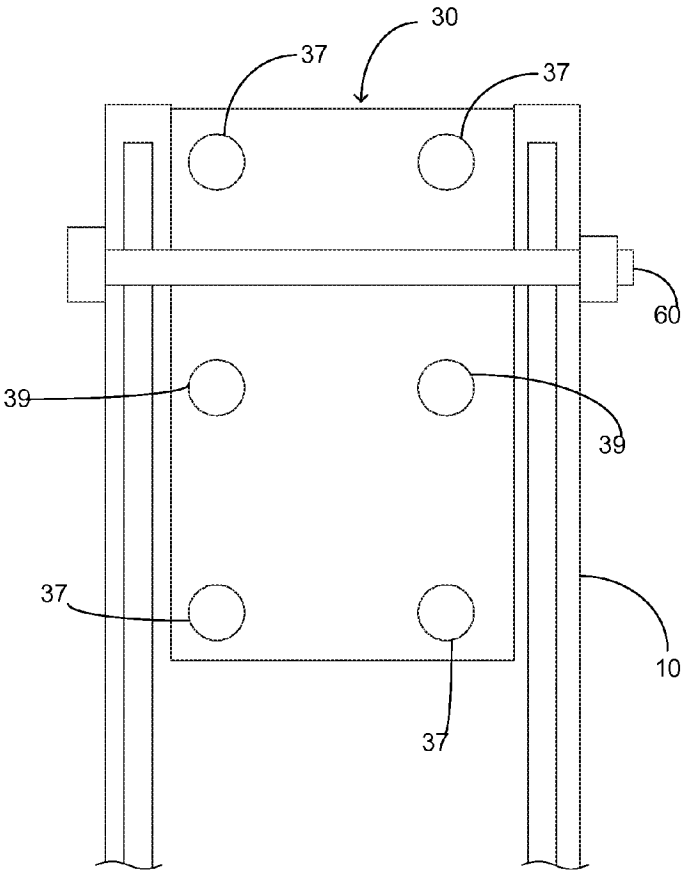
FIG. 4 is a diagrammatic view of the horizontal cross beam coupled with a vertical support column.

The horizontal crossbeam 30 includes a first portion 32, a second portion 34 and a third portion 36 that are integrally formed from concrete. As previously discussed herein, the concrete for the preferred embodiment is 3500 psi concrete or 5000 psi concrete. The horizontal crossbeam 30 extends intermediate the first vertical column 10 and second vertical column 20 and includes second portion 34 that extends beyond second vertical column 20 and third portion 36 that extends beyond first vertical column 10. While no particular length of the horizontal crossbeam 30 is required, good results have been achieved utilizing a horizontal crossbeam 30 that is approximately thirty-seven feet in length. As shown in FIG. 4 herein, the horizontal crossbeam 30 includes four corner support bars 37 and two central support bars 39. The four corner support bars 37 extend the length of the horizontal crossbeam 30 and are manufactured from #6 metal bars. The two central support bars 39 extend the length of the horizontal crossbeam 30 and are manufactured from #5 metal bars. Furthermore in the preferred embodiment the horizontal crossbeam 30 will have #2 to #4 stirrups being ten inches on center. As shown in FIG. 1, swings 99 are suspendedly mounted from the horizontal crossbeam 30.

Still referring to FIG. 4, the horizontal crossbeam 30 is secured to the first vertical column 10 utilizing bolt 60. In the preferred embodiment of the present invention, bolt 60 is at least a one-half inch diameter bolt and is completely journaled therethrough.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A swing set mounted to the ground comprising:

a first vertical column, said first vertical column having an upper end and a lower end, said lower end of said first vertical column being inserted into the ground, said first vertical column being manufactured from concrete, said first vertical column being square in shape having four corners, said first vertical column having a void proximate the upper end thereof, said void having a portion of the first vertical column on opposing sides thereof;

a second vertical column, said second vertical column having a lower end and an upper end, said second vertical column being in axial alignment with said first vertical column, said lower end of said second vertical column being inserted into the ground, said second vertical column being square in shape having four corners, said second vertical column having a void proximate the upper end thereof, said void having a portion of the second vertical column on opposing sides thereof;

a horizontal crossbeam, said horizontal crossbeam being operably coupled to said first vertical column and said second vertical column and being perpendicular therewith, said horizontal crossbeam being secured within the voids proximate the upper end of said first vertical column and the upper end of said second vertical column; and a pair of mounting pads, said pair of mounting pads being positioned underneath the ground, said pair of mounting pads being square in shape, said pair of mounting pads operable to receive thereon the first vertical column and the second vertical column.

2. The swing set as recited in claim 1, wherein said first vertical column includes four reinforcement bars mounted in the corners thereof being manufactured from #5 metal bars and further including stirrups at forty eight inch centers.

3. The swing set as recited in claim 2, wherein said second vertical column includes four reinforcement bars mounted in the corners thereof being manufactured from #5 metal bars and further including stirrups at forty eight inch centers.

4. The swing set as recited in claim 3, wherein said horizontal beam is approximately thirty seven feet in length and further includes six metal support bars extending the length thereof wherein the six metal support bars further include stirrups at ten inch centers.

5. The swing set as recited in claim 4, and further including a first bolt and a second bolt, said first bolt and said second bolt operable to secure said horizontal crossbeam to said first vertical column and said second vertical column respectively.

6. The swing set as recited in claim 5, wherein said first vertical column and said second vertical column are approximately fifteen feet in height.

7. The swing set as recited in claim 6, wherein the pair of mounting pads include an upper surface that is approximately nine square feet.

8. The swing set as recited in claim 7, wherein the swing set has at least six swings suspendedly mounted thereto.

9. A swing set mounted to the ground wherein the swing set has improved structural integrity comprising:

a first vertical column, said first vertical column having an upper end and a lower end, said lower end of said first vertical column being inserted into the ground, said first vertical column being manufactured from concrete, said first vertical column being square in shape having four corners, said first vertical column further including a mounting structure, said mounting structure being proximate the upper end thereof, said mounting structure being integrally formed with the upper end of said first vertical column, said mounting structure having a void, said void of said mounting structure having a portion of the first vertical column on opposing sides thereof, said first vertical column including four reinforcement bars mounted in the corners thereof being manufactured from #5 metal bars and further including stirrups at forty eight inch centers;

a second vertical column, said second vertical column having a lower end and an upper end, said second vertical column being in axial alignment with said first vertical column, said lower end of said second vertical column being inserted into the ground, said second vertical column being square in shape having four corners, said second vertical column further including a mounting structure, said mounting structure being proximate the upper end thereof, said mounting structure being integrally formed with the upper end of said second vertical column, said mounting structure having a void, said void of said mounting structure having a portion of the second vertical column on opposing sides thereof, said second vertical column including four reinforcement bars mounted in the corners thereof being manufactured from #5 metal bars and further including stirrups at forty eight inch centers;

a horizontal crossbeam, said horizontal crossbeam being operably coupled to said first vertical column and said second vertical column and being perpendicular therewith, said horizontal crossbeam being secured within the void of the mounting structure proximate the top of the first vertical column and the second vertical column, said horizontal beam being approximately thirty seven feet in length and further including six metal support bars extending the length thereof, wherein the six metal support bars further include stirrups at ten inch centers; and a pair of mounting pads, said pair of mounting pads being positioned underneath the ground, said pair of mounting pads being square in shape, said pair of mounting pads having an upper end and a lower end, said pair of mounting pads having a width proximate the upper end that is equal to the width proximate the lower end, said pair of mounting pads operable to receive thereon the first vertical column and the second vertical column.

10. The swing set as recited in claim 9, wherein the swing set is manufactured from 3500 psi concrete.

11. The swing set as recited in claim 9, wherein the swing set is manufactured from 5000 psi concrete.

12. The swing set as recited in claim 9, wherein the swing set has at least six swings suspendedly mounted thereto.

13. The swing set as recited in claim 12, wherein the pair of mounting pads include an upper surface that is approximately nine square feet.

14. The swing set as recited in claim 13, wherein said first vertical column and said second vertical column are approximately fifteen feet in height.

* * * * *